US007637238B2

(12) United States Patent
Haefner et al.

(10) Patent No.: US 7,637,238 B2
(45) Date of Patent: Dec. 29, 2009

(54) HYDRAULIC VALVE PLAY COMPENSATING ELEMENT

(75) Inventors: Donald Haefner, Troy, MI (US); Lu Zhu, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 153 days.

(21) Appl. No.: 11/903,368

(22) Filed: Sep. 21, 2007

(65) Prior Publication Data

US 2008/0073608 A1 Mar. 27, 2008

Related U.S. Application Data

(60) Provisional application No. 60/846,550, filed on Sep. 22, 2006.

(51) Int. Cl.
*F01L 1/14* (2006.01)

(52) U.S. Cl. ..... 123/90.52; 123/90.45; 123/90.46; 123/90.55

(58) Field of Classification Search ..... 123/90.12, 123/90.13, 90.45, 90.46, 90.52, 90.55, 90.56, 123/90.58; 74/567, 569; 251/120, 121, 122; 91/170, 182, 183

See application file for complete search history.

(56) References Cited

U.S. PATENT DOCUMENTS 7,047,925 B2 * 5/2006 Hendriksma et al. ..... 123/90.45

* cited by examiner

*Primary Examiner*—Ching Chang
(74) *Attorney, Agent, or Firm*—Charles A. Muserlian

(57) ABSTRACT

A hydraulic valve play compensating element for generating valve play compensation for a gas exchange valve in a valve operating mechanism of an internal combustion engine, having a piston housing in which a piston, which is elastically supported against the piston housing via a piston spring, is guided in a movable fashion, in which the piston has a low-pressure space which is connected via an axial opening in a piston head to a high-pressure space which is enclosed by the piston housing, and having a control valve which has at least one control valve closing element which can bear in a seal-forming fashion against a valve seat, the letter surrounding the axial opening on a piston head underside, and comprises a control valve spring which is preloaded in the opening direction, wherein, in the event of a collapsing movement between the piston and the piston housing when the gas exchange valve is actuated, the control valve closing element can be acted on hydraulically in the closing direction by means of a build-up of pressure in the high-pressure space wherein the control valve spring is embodied as a spring element which is arranged in the high-pressure space, is radially spaced apart from the axial opening and from the control valve closing element and is supported between the piston head underside and a control valve holding element which is guided in the high-pressure space in an axially movable fashion with a delimited actuating travel, holds the control valve closing element and is provided with an oil passage.

16 Claims, 3 Drawing Sheets

HYDRAULIC VALVE PLAY COMPENSATING ELEMENT

PRIOR APPLICATION

This application is based on provisional application Ser. No. 60/846,550 filed Sep. 22, 2006.

FIELD OF THE INVENTION

The invention relates to a hydraulic valve play compensating element, for example for generating valve play compensation for a gas exchange valve in a valve operating mechanism of an internal combustion engine, having a piston housing in which a piston, which is elastically supported against the piston housing via a piston spring, is guided in a movable fashion, in which the piston has a low-pressure space which is connected via an axial opening in a piston head to a high-pressure space which is enclosed by the piston housing, and having a control valve which has at least one control valve closing element which can bear in a seal-forming fashion against a valve seat, the latter surrounding the axial opening on a piston head underside, and comprises a control valve spring which is preloaded in the opening direction, wherein, in the event of a collapsing movement between the piston and the piston housing when the gas exchange valve is actuated, the control valve closing element can be acted on hydraulically in the closing direction by means of a build-up of pressure in the high-pressure space.

BACKGROUND OF THE INVENTION

Hydraulic valve play compensating elements, also referred to for short below as HVA, serve, in valve drives of internal combustion engines, for the autonomous compensation of valve play which is generated by production tolerances, thermal expansion and wear in the mechanical transmission chain between cams, cam followers and gas exchange valves. The valve play compensation is generally realized by means of a piston which is guided in an axially moveable manner, and is elastically supported with a piston spring, in a piston housing associated with a valve drive element of the valve drive. The piston spring generates a preload which acts in the transmission chain and which compensates any occurring valve play, with the lifting movement which is to be transmitted to the gas exchange valves being controlled by means of a hydraulically actuable control valve between the piston and piston housing. As a result of the autonomous play compensation, the noise and wear behavior of the valve drive is significantly improved over valve drives without valve play compensation or with manually adjustable valve play compensation. In addition, valve play compensation elements can be utilized as switchable and/or adjustable actuating means in the case of variable control of the valve lifts and/or of the opening and closing times of the intake-side and exhaust-side gas exchange valves, as is described for example in DE 103 00 724 A1.

In a standard design, conventional hydraulic valve play compensation elements use a control valve which is embodied as a non-return valve and which has a control valve closing element and a control valve spring, with the latter acting on the control valve element. The control valve closing element is conventionally embodied as a spherical or sphere-like closing body which is loaded with a force in the closing direction by a coil pressure spring. In this way, the control valve is usually closed, so that the compensating element acts predominantly as a "rigid" actuating element, in which an axial force loading is transmitted directly to the associated gas exchange valve. With said design, however, as a result of the construction, and in particular when the engine is cold and in the event of production inaccuracies in the base circle of the cam, a so-called surging of the control valve with a negative valve play cannot be excluded, which can lead to increased wear and, in the worst case, to engine damage.

Said disadvantages are avoided in the so-called reverse spring hydraulic valve play compensating elements which are also referred to for short below as RSHVA and are known for example from DE 10 2004 018 457 A1. Here, the control valve springs are arranged inversely, so that the control valve ball is acted on in the opening direction, usually delimited by a stop face of a valve cap, and the control valve acts predominantly as a "soft" element. In the case of an RSHVA, at the beginning of a cam lift, an axial force is exerted on the valve play compensating element. Here, a control oil flow is set up from a high-pressure space of an outer housing of the RSHVA to a low-pressure space within a piston, which is movable axially with respect to the housing, of the RSHVA via a piston bore which connects the pressure spaces, which control oil flow acts on the control valve ball. Here, the play compensating element begins to collapse and initially generates an idle stroke until the hydrodynamic and hydrostatic forces of the control oil press the ball counter to the opening spring force and into its valve seat and thereby close the valve, and the gas exchange valve is subsequently actuated.

The influence of the idle stroke, which is typical of the RSHVA, on the overlap of the valve opening and closing times between intake and exhaust valves, and the engine-speed-dependent profile of said influence, can be incorporated in the valve controller in a targeted fashion in order to improve the idle stroke behavior, the thermodynamic efficiency and the pollutant emission optimization of the internal combustion engine.

A problem of the reverse spring valve play compensating elements of the conventional design, having a control valve ball, an opening control valve spring which is embodied as a coil pressure spring which is positioned in an axial piston bore, and a valve cap which holds the control valve ball, has proven to be the relatively complex flow conditions of the control oil between the low-pressure space and the high-pressure space. Tests have shown that in particular the windings of the coil pressure spring hinder the hydraulic flow and make the latter harder to calculate. The valve ball which is acted on with a force by the spring covers the central longitudinal opening of the spring. Since the oil flow also cannot pass the narrow spring windings of the extremely small components, or can pass the narrow spring windings of the extremely small components only to an insufficient extent, the oil flow is restricted substantially to the narrow region between the spring outer periphery and the walls of the piston opening. In addition, the flow through the openings of the conventional valve cap which functions as a stop and guide means for the control valve ball, are made more complicated. Even slight oil-type-related and/or temperature-dependent changes in viscosity of the control oil and production tolerances on the decisive components can therefore lead, in said play compensating element types, to relatively great functional fluctuations during operation, in particular to high idle stroke tolerances, which can unfavorably influence the operating behavior of the internal combustion engine. On the other hand, high demands on the production and material tolerances are expensive and difficult to adhere to.

JP 611 856 07 A discloses a hydraulic valve play compensating element in a hydraulic tappet of a valve drive, in which a disk-shaped spring element which is recessed in the opening direction is arranged below a piston head. Held below the spring element, in a cylindrical valve cap, is a freely moveable control valve ball (a so-called "freeball"). The has a central opening whose diameter is smaller than the diameter of the valve ball, so that in the unpressurized state, the valve ball cannot close off a piston bore. Consequently, in the event of a hydraulic loading of the valve ball in the closing direction, the valve ball is initially pressed against the border of the central opening of the spring disk, and the spring disk is placed in contact with the piston head by overcoming its preload. Here, the control oil which flows past the valve ball at the sides can pass the piston bore via a further opening in the border region of the spring disk until the valve ball closes off the piston bore.

As a result of said arrangement, an engine-speed-dependent oil flow via the control valve is set up in the event of a cam loading by means of a camshaft. With rising cam speed, the oil flow is reduced until the closure of the control valve, as a result of which a piston collapsing movement is reduced and a valve lift of a gas exchange valve is correspondingly enlarged, which leads to more effective cylinder charging in the associated cylinder and therefore to increased engine power. At low engine speeds, in contrast, the valve lift is reduced as a result of the comparatively large idle stroke, as a result of which a fuel saving can be obtained. Here, the spring disk which is embodied as a plate spring acts as a control element.

Said document has the aim of an engine-speed-dependent valve lift variation by means of the idle stroke of an RSHVA, but makes no reference to the flow conditions of the control oil within the RSHVA during its lifting movements. Here, although no spring windings block the flow shortly upstream of or within the piston bore, a disadvantage of the known arrangement is that, in the event of a pressure build-up in the high-pressure space, the oil flow passes initially between the walls of the valve cap and the ball surface, past an upper border of the valve cap and via the outer opening of the spring disk in a ball-ring-shaped flow space, which is formed by the plate-shaped geometry of the spring disk, along the piston head underside, and is deflected upstream thereof to the piston bore before passing the piston bore. Said flow path which is sensitive to boundary layer and turbulence effects can therefore, like in the case of a coil spring within the piston bore, result in undesirably high functional fluctuations in operation in the event of relatively small production and/or material tolerances.

Since, during the closing process of the valve, the control valve ball directly drives the plate spring and in doing so engages partially into the central opening of the spring, high demands must be made in terms of production tolerances on the spring geometry and its assembly position and on the ball in order to preclude significant actuating travel fluctuations. In addition, as a result of the plate-shaped geometry of the spring, lateral clamping forces can act on the ball, which lateral clamping forces can adversely affect correct abutment of the closing element against the piston opening.

In addition, in the event of a relaxation movement, which follows the cam loading, of the compensating element in the cam base circle when the gas exchange valve is closed, during which relaxation movement the piston and piston housing are pushed apart again by the piston spring until there is no play present between the cam follower and the cam, the return flow of the control oil from the low-pressure space (reservoir) to the high-pressure space can be unfavorably hindered by means of the relatively restricted flow path via the ball, plate spring and valve cap.

OBJECT OF THE INVENTION

The invention is based on the object of creating a hydraulic valve compensating element of reverse spring design which has a simpler, more cost-effective and flow-enhancing design and at the same time permits more reliable operation which is largely unsusceptible to tolerances.

SUMMARY OF THE INVENTION

The invention is based on the knowledge that, in an RSHVA, flow-related and production-tolerance-related functional fluctuations in operation can be considerably reduced by eliminating the unfavorable influences, which are caused in particular by the opening control valve spring, on the control oil flow, in connection with the creation of as rectilinear and unobstructed a flow path as possible.

The invention therefore proceeds from a hydraulic valve play compensating element, for example for generating valve play compensation for a gas exchange valve in a valve operating mechanism of an internal combustion engine, having a piston housing in which a piston, which is elastically supported against the piston housing via a piston spring, is guided in a movable fashion, in which the piston has a low-pressure space which is connected via an axial opening in a piston head to a high-pressure space which is enclosed by the piston housing, and having a control valve which has at least one control valve closing element which can bear in a seal-forming fashion against a valve seat, the latter surrounding the axial opening on a piston head underside, and comprises a control valve spring which is preloaded in the opening direction, wherein, in the event of a collapsing movement between the piston and the piston housing when the gas exchange valve is actuated, the control valve closing element can be acted on hydraulically in the closing direction by means of a build-up of pressure in the high-pressure space.

It is additionally provided that the control valve spring is embodied as a spring element which is arranged in the high-pressure space, is radially spaced apart from the axial opening and from the control valve closing element and is supported between the piston head underside and a control valve holding element which is guided in the high-pressure space in an axially movable fashion with a delimited actuating travel, holds the control valve closing element and is provided with an oil passage.

By means of said arrangement, a geometric simplification of the flow path for the control oil is obtained. Here, the otherwise conventional control valve spring is removed from the piston opening and is relocated, below the piston head, outward adjacent to the inner wall of the high-pressure space, so that the restrictive action of the control valve spring or of the spring windings on the hydrodynamic oil flow is eliminated, and the control oil can pass the axial opening unhindered.

According to the invention, the radially outwardly relocated control valve spring transmits its preload force to the closing element by means of a control valve holding element which is arranged so as to be axially moveable in the high-pressure space and which absorbs the preload of the control valve spring. Here, at the same time, the preload of the control valve spring is realized, and a maximum actuating travel of the control valve closing element is defined, by means of an actuating travel delimitation of the control valve holding element.

Arranged in the control valve holding element is an oil passage via which the control oil is transferred or can flow back in the direction of the high-pressure space during the hydrodynamic and hydrostatic loading of the closing element during the collapsing movement of the RSHVA.

The outwardly relocated control valve spring in operative connection with the control valve holding element, which guides the control valve closing element, with its oil passage, permits a considerably simplified, pre-calculable oil transfer via the control valve, with a relatively large flow cross section during the discharge of the control oil through the axial opening into the low-pressure space, so that a particularly effective and uniform closing process of the control valve is obtained in operation. Production tolerances on the control valve spring, piston opening or closing body and temperature and viscosity effects have a considerably reduced influence on important operating parameters, such as the closing time and idle stroke tolerance, of the compensating element as a result of the simplified and more efficient flow path in this arrangement. Disturbing functional fluctuations are therefore largely prevented. This is obtained without increased demands on production and material accuracies, which has a cost-saving effect.

It is particularly advantageous for a coil pressure spring, whose outer diameter is matched approximately to the inner diameter of the high-pressure space, to be used as an opening control valve spring. Coil pressure springs are available as cost-effective, simple and compact spring means for generating the preloads on the closing element which are necessary in the RSHVA, and have been proven in this regard. As a result of as large a diameter of the coil pressure spring as possible, the spring windings run adjacent to the inner wall of the high-pressure space, that is to say at a relatively great distance from the axial opening and the closing element, so that said spring windings have no disruptive influence on the flow of the control oil between the pressure spaces, and in particular cannot hinder said flow.

It is possible for a disk or plate to be provided as a particularly simple control valve holding element for transmitting the spring load of the outwardly-situated control valve spring to a valve closing element, which disk or plate is guided with sealing play with respect to the inner wall of the high-pressure space. The disk can have an encircling border which facilitates correct guidance of the control valve holding element in the high-pressure space and at the same time can be advantageously utilized for centering and radially fixing the control valve spring.

It can additionally be provided that the oil passage which is arranged in the control valve holding element is embodied as a hole circle. The control valve holding element, which is advantageously embodied as a disk and has a border, forms, with the hole circle, a multi-holed sleeve. A sleeve of said type is simple and cost-effective to produce. By means of the control valve holding element which is provided with the oil passage, in particular by means of the holed sleeve which is formed in this way, a multi-functional component is provided which, in addition to its function as a holding element and transmission means for transmitting the spring force to a closing body or a closing element, also offers an effective means for flow regulation of the control oil flow.

By varying the number and size of the individual holes of the hole circle, the flow cross section, the flow speed and the absolute oil quantity which flows between the pressure spaces can be set in operative connection with a pressure difference, generated by means of the control valve holding element, between the upper side and underside of the control valve holding element during an opening process or the closing process of the control valve. It is of course possible by means of other cutouts to also realize corresponding other oil passage geometries, that is to say geometries which differ from the circular shape.

In order to delimit the axial actuating travel of the control valve holding element in the opening direction, it is possible for a securing element to be provided which is arranged on that side of the control valve holding element which faces away from the axial opening and on a piston head border. A particularly simple securing element can be embodied as a securing ring which is pressed into a recess of the piston head border. The securing ring can of course be fixedly connected to the piston head border in some other way.

As a result of the securing ring, it is possible for the conventional valve cap, which is usually provided with opening slots for the passage of oil and if appropriate with guide means for closing body guidance and is relatively complex, according to the prior art to be dispensed with. In particular, the flow path of the control oil is further simplified in this way. Dispensing with the valve cap can additionally have a cost-saving effect on the production costs of the control valve.

In addition, the underside, which faces away from the control valve element, of the securing element can advantageously be embodied as a spring seat for holding the piston spring. Here, the securing element replaces the previously conventional support of the piston spring by means of a collar of the valve cap on the piston head underside.

It can additionally be provided that the control valve closing element is fixedly connected, coaxially with respect to the axial opening, to the control valve holding element. Here, the control valve holding element serves at the same time as a guide element during the closing body movement. By means of guidance of the control valve holding element with sealing play in the high-pressure space, which is generally arranged coaxially with respect to the low-pressure space and with respect to the axial opening, the closing body, by means of a central fixed connection to the control valve holding element, is automatically fixed in the radial direction and is guided coaxially with respect to the axial opening by means of the control valve element. In this way, no additional separate guide aids, or guide aids formed on the closing body itself, are required, which has a further cost-saving effect.

It is possible for a cost-effective, conventional control valve ball, if appropriate with a reduced diameter, to be used as a control valve closing element, which control valve ball is joined for example by means of a press fit in a central bore of the control valve element. Also possible, however, are other, in particular spheroidal or conical closing body shapes which can have a favorable effect on the flow conditions between the pressure spaces. Here, the valve seat and/or the axial opening can be matched the contour of the control valve closing element, wherein the valve seat can also be formed by the wall of the opening itself. In the case of conical shapes in particular, it is possible for corresponding suitable openings to be produced simply and cost-effectively with low production tolerances.

As a result of the fixed connection of the control valve closing element to the control valve holding element, a reverse spring element in the conventional sense is provided, in which—as explained in the introduction—the opening control valve spring acts on a closing body in the opening direction. Also possible, however, is a combination of the control valve holding element which is preloaded by the opening spring with a control valve ball which is freely moveable between the control valve holding element and the valve seat, as is known—without a spring element—from the so-called freeball systems. Here, the control valve is not coercively closed in the unpressurized state, that is to say in the cam base circle. According to the invention, it is hereby possible for the control valve holding element to function as a guide aid and receptacle instead of a valve cap. During the closing of the control valve, the closing body is centered, and placed securely on the valve seat, by means of a central opening of the control valve holding element. Here, the movement of the control valve holding element can assist the hydrostatic and hydrodynamic loading of the closing body in the closing direction.

It can additionally be provided that the control valve closing element is embodied as a closing region which is integrated into the control valve holding element, coaxially adjacent to the axial opening. Said closing region can, corresponding to the conventional ball surface of a control valve ball, form a spherical surface. Also possible, however, are other, for example spheroidal or conical surfaces. In order to obtain as closely-fitting a laminar flow around the closing region as possible, it is advantageously possible for a continuous transition region to be formed between the closing region and a flat and radial region, which adjoins said closing region, of the control valve holding element. A similar transition region can also be arranged between the closing body, which is fixedly joined into the control valve holding element, and the flat and radial region which adjoins said closing body.

By means of the integrated closing region, a control valve is created which, in a component or in a control valve disk, simultaneously fulfils the closing and closing body guide function and, by means of the control valve spring, the reverse spring function, which has a favorable effect on the production and assembly costs. As a planar formation of the control valve plate, the closing region is additionally installation-space-saving and weight-saving.

Since a comparatively small radius of the closing element is possible in the arrangement according to the invention, no weight disadvantage is associated with the control valve composed of the closing element, control valve holding element and securing element in relation to the conventional control valve with the relatively large closing body and valve cap. It is even possible when replacing the closing body with a closing region which is integrated into the control valve holding element to obtain a weight saving.

BRIEF DESCRIPTION OF THE DRAWINGS

The invention is explained in more detail below on the basis of the appended drawings in terms of some embodiments. In the drawings.

DETAILED DESCRIPTION OF THE DRAWINGS

Figure 1:
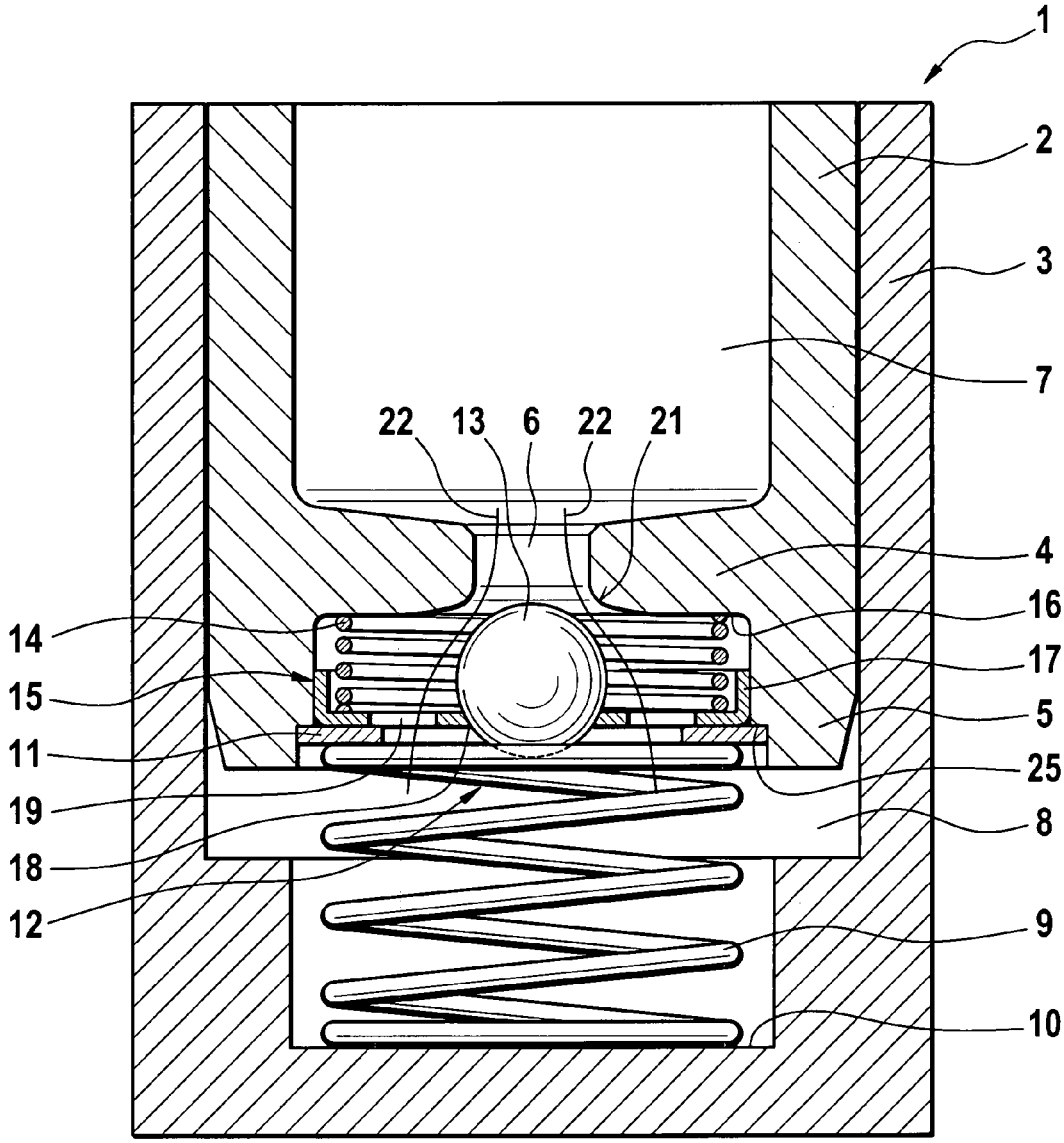
FIG. 1 shows, in a longitudinal section, a detail of an RSHVA according to the invention having a control valve according to the invention, in the open position.

The reverse spring hydraulic valve play compensating element shown in FIG. 1 is advantageously embodied as a hydraulic tappet 1, which is assigned to a valve drive element for actuating a gas exchange valve, for example a roller rocker arm, of a valve drive (not illustrated) of an internal combustion engine in a vehicle.

The tappet 1 comprises a hydraulic cylindrical piston 2 which is guided so as to be axially moveable with sealing play in a piston housing 3. At its lower end, the piston 2 has a piston head 4 with a peripheral piston head border 5. The piston head 4 has an axial opening which is embodied as an axial piston bore 6 and which connects a low-pressure space 7, which is embodied as an oil reservoir, within the piston 2 to a high-pressure space 8, which is enclosed by the piston housing 3, below the piston head 4. The oil reservoir 7 can, for the supply of the tappet 1, be fed via an oil supply (not illustrated) with a hydraulic fluid which serves as control oil.

The piston 2 and the piston housing 3 are elastically supported against one another by means of a piston spring 9 which is embodied as a coil pressure spring, with one of the two compensating parts 2, 3 being supported at its outer face-side end at the cam side, and the other of the two compensating parts 2, 3 being supported at its outer face-side end at the gas exchange valve side, so that, by means of the piston spring 9, autonomous play compensation of any valve play in the valve drive element between a gas exchange valve and a cam can be generated. The piston spring 9 is supported in the high-pressure space 8 between a piston house base 10 and a securing element 11. The securing element 11 is embodied as a securing ring which is pressed into a recess 25 of the piston head border 5. The underside of the securing ring 11 serves as a spring seat for the piston spring 9.

Arranged on the piston head 4 is a control valve 12 according to the invention, by means of which control valve 12 the high-pressure space 8 and the low-pressure space 7 can be fluidically separated. The control valve 12 comprises a control valve closing element 13 which is embodied as a control valve ball, a control valve spring 14 and a control valve holding element 15. The control valve spring 14 is embodied as a coil pressure spring which is supported, radially spaced apart from the piston bore 6, between a piston head underside 16 and the control valve holding element 15.

The control valve holding element 15 is embodied as a disk-shaped plate which is produced for example from sheet metal and which is enclosed by an integrally formed axial border 17. The control valve holding element 15, which is also referred to for short as a holding plate 15, is guided, by means of the border 17, with sealing play and so as to be axially moveable in the piston head border 5. The holding plate 15 has a central opening 18 in which the control valve ball 13 is held and fixedly connected to said holding plate 15 by means of a press fit. In addition, the holding plate 15 has an oil passage 19 which is formed as a hole circle arranged between the central opening 18 and the border 17.

Figure 2:
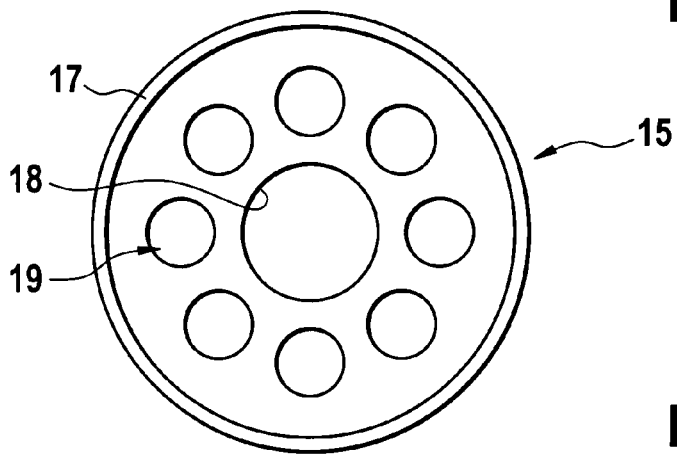
FIG. 2 shows a control valve holding element of the control valve in a plan view.

FIG. 2 shows the hole circle 19, which is composed of eight individual circular recesses, in a plan view in detail. The region which remains radially between the hole circle 19 and the border 17 serves as a contact face (spring seat) of the control valve spring 14.

Figure 3:
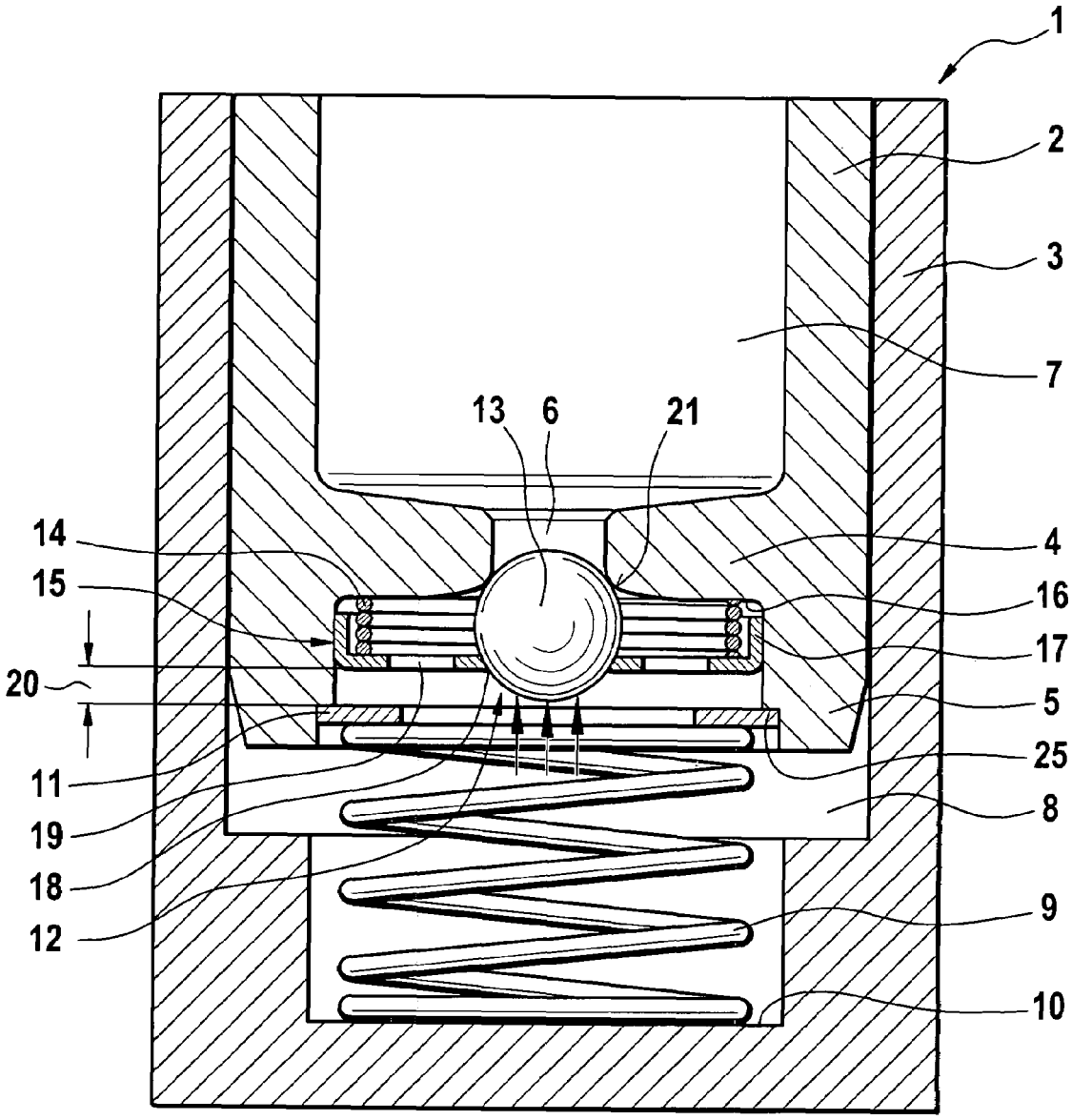
FIG. 3 shows the RSHVA as per FIG. 1 with the control valve in the closed position.

FIG. 1 shows the control valve 12 in the open position and FIG. 3 shows the control valve 12 in the closed position. The control valve spring 14 has a preload which is realized by means of the delimitation of an axial actuating travel 20 (FIG. 3) of the holding plate 15. The preload is transmitted by means of the holding plate 15 to the control valve ball 13 which is fixedly connected to the holding plate 15. Here, the upper side of the securing ring 11 serves as a stop of the holding plate 15. The actuating travel 20 at the same time defines an actuating travel of the control valve ball 13.

In the open position (FIG. 1), the holding plate 15 lies flat on the securing ring 11 and is held in said position by means of the spring preload. Here, the holding plate 15 drives the control valve ball 13 in the opening direction, that is to say away from the piston bore 6, by the actuating travel 20. In the closed position (FIG. 3), the control valve spring 14 is compressed by the actuating travel 20 in the closing direction, and the control valve ball 13 bears sealingly against a valve seat 21 of the piston bore 6.

Figure 4:
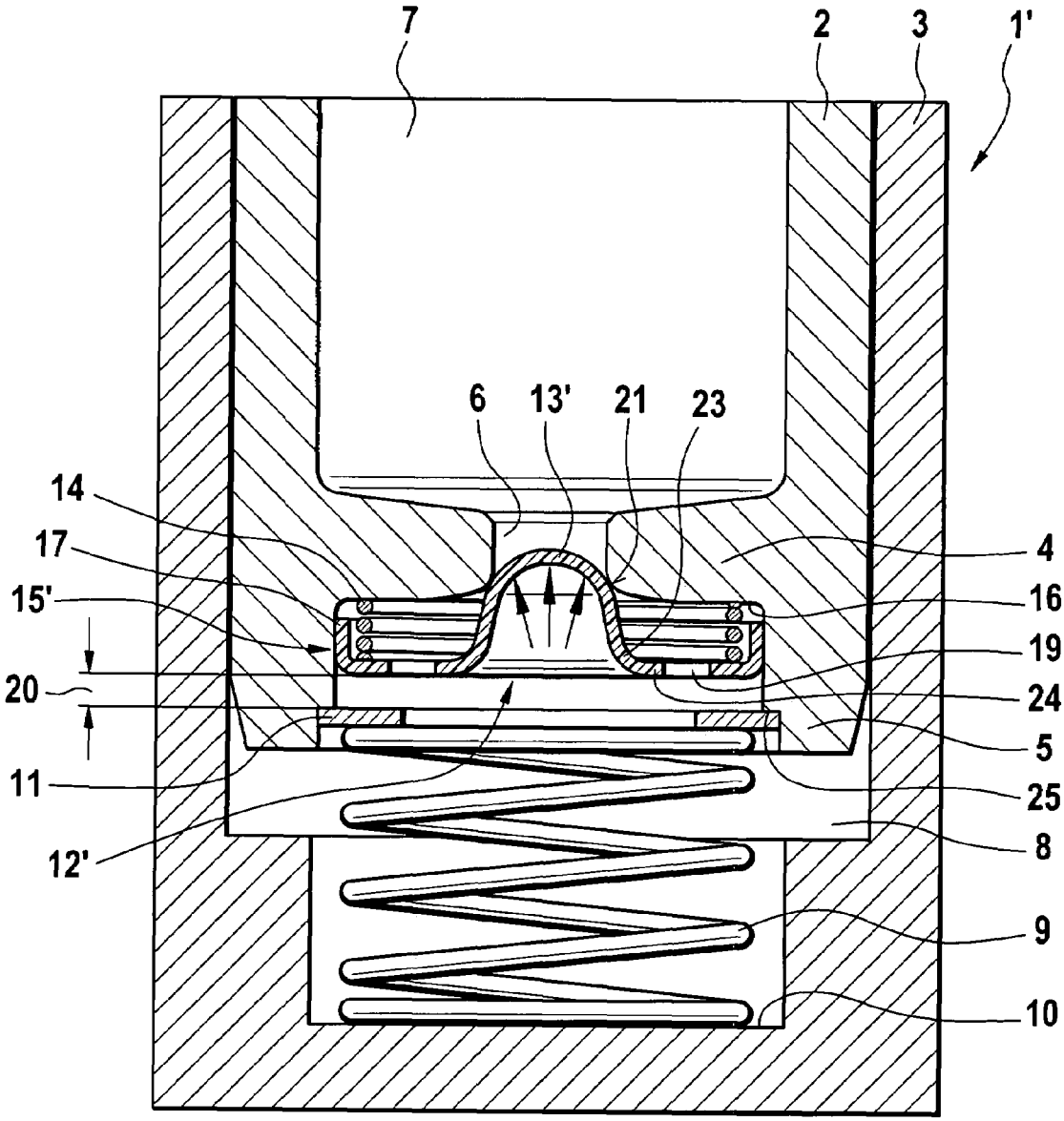
FIG. 4 shows an RSHVA according to the invention having a second embodiment of the control valve in the closed position.

FIG. 4 shows a second embodiment of a tappet 1' having a control valve 12'. Provided here instead of a closing body such as the control valve ball 13 as a control valve closing element is a control valve closing element 13' which is embodied as a closing region. The closing region 13, is integrated in one piece into a holding plate 15' and is embodied as a spherical surface region of the holding plate 15'. Formed between the spherical surface region 13' and an adjoining flat region 24 of the holding plate upper side is a continuous transition region 23, with which the oil flow which flows past can be in close and largely laminar contact.

The mode of operation of the tappet 1 as per FIGS. 1 to 3 is based on the known reverse spring principle:

In the cam base circle of a cam which is associated with a camshaft of the internal combustion engine, the control valve 12 is opened by means of the opening control valve spring 14, and an associated gas exchange valve is closed. During the further rotation of the camshaft which is driven by means of a crankshaft, a cam loading of the tappet 1 is initiated, during which the tappet 1 is compressed and begins to collapse. Initially, a control oil volume flow flows around the control valve ball 13 in the closing direction, and in doing so acts hydrodynamically and hydrostatically on said control valve ball 13. Here, the control oil flows from the high-pressure space 8 via the oil passage 19 of the holding plate 15 and through the piston bore 6 into the low-pressure space 7. The largely unhindered continuous oil flow is indicated in FIG. 1 by two streamlines 22.

As a result of the collapsing movement, initially an idle stroke is generated which is characteristic of the reverse spring tappet 1. With increasing volume flow rate, the pressure losses which are generated in the oil flow above the holding plate 15, and the dynamic pressure which is generated below the holding plate 15, finally in an load-exerting force which overcomes the preload force of the control valve spring 14, so that the holding plate 15 is lifted from the securing ring 11 and, as a result, the control valve ball 13 is pressed against the valve seat 21 and the control valve 12 is closed.

Only once the control valve 12 is closed is the further cam loading transmitted to the gas exchange valve which is to be actuated, and said gas exchange valve opened. During the further rotation of the camshaft, the cam returns to the base circle, so that the tappet 1 expands elastically by means of the piston spring 9 while compensating the valve play. As a result, the control valve 12 is opened by means of the control valve spring 14 as a result of the pressure drop in the high-pressure space 8, with a control oil return flow taking place from the reservoir 7 into the high-pressure space 8, and the tappet 1 is placed back into its initial state for renewed loading.

The mode of operation of the tappet 1' as per FIG. 4, having the control valve 12' and the control valve closing element which is integrated into the control valve holding element 15', takes place in a similar way to the previously described mode of operation, with the spherical closing region 13' functioning in place of the control valve ball 13.

LIST OF REFERENCE SYMBOLS

1, 1' Tappet
2 Piston
3 Piston housing
4 Piston head
5 Piston head border
6 Axial opening, piston bore
7 Low-pressure space, reservoir
8 High-pressure space
9 Piston spring
10 Piston housing base
11 Securing element, securing ring
12, 12' Control valve
13, 13' Control valve closing element
14 Control valve spring
15, 15' Control valve holding element, holding plate
16 Piston head underside
17 Holding element—border
18 Central holding element—opening
19 Oil passage, hole circle
20 Actuating travel
21 Valve seat
22 Streamline
23 Transition region
24 Flat region
25 Recess

The invention claimed is:

1. A hydraulic valve play compensating element for generating valve play compensation for a gas exchange valve in a valve operating mechanism of an internal combustion engine, having a piston housing in which a piston, which is elastically supported against the piston housing via a piston spring, is guided in a movable fashion, in which the piston has a low-pressure space which is connected via an axial opening in a piston head to a high-pressure space which is enclosed by the piston housing, and having a control valve which has at least one control valve closing element which can bear in a seal-forming fashion against a valve seat, the latter surrounding the axial opening on a piston head underside, and comprises a control valve spring which is preloaded in the opening direction, wherein, in the event of a collapsing movement between the piston and the piston housing when the gas exchange valve is actuated, the control valve closing element can be acted on hydraulically in the closing direction by means of a build-up of pressure in the high-pressure space wherein the control valve spring is embodied as a spring element which is arranged in the high-pressure space, is radially spaced apart from the axial opening and from the control valve closing element and is supported between the piston head underside and a control valve holding element which is guided in the high-pressure space in an axially movable fashion with a delimited actuating travel, holds the control valve closing element and is provided with an oil passage.

2. The hydraulic valve play compensating element of claim 1, wherein the control valve spring is embodied as a coil pressure spring whose outer diameter is matched approximately to an inner diameter of the high-pressure space.

3. The hydraulic valve play compensating element of claim 1, wherein the control valve holding element is embodied as a disk-shaped plate which is guided with sealing play with respect to the inner wall of the high-pressure space.

4. The hydraulic valve play compensating element of claim 3, wherein the control valve holding element is enclosed in or has a border which acts as a guide aid.

5. The hydraulic valve play compensating element of claim 1 wherein the oil passage which is arranged in the control valve holding element is embodied as a hole circle with a plurality of holes.

6. The hydraulic valve play compensating element of claim 1 wherein the axial actuating travel of the control valve holding element is delimited in the opening direction by a securing element which is arranged on that side of the control valve holding element which faces away from the axial opening and on a piston head border.

7. The hydraulic valve play compensating element of claim 6, wherein the securing element is embodied as a securing ring which is pressed into a recess of the piston head border.

8. The hydraulic valve play compensating element of claim 6, wherein the underside, which faces away from the control valve element, of the securing element is embodied as a spring seat for holding the piston spring.

9. The hydraulic valve play compensating element of claim 1 wherein the control valve closing element is fixedly connected, coaxially with respect to the axial opening, to the control valve holding element.

10. The hydraulic valve play compensating element of claim 1 wherein the control valve closing element is embodied as a closing body which is held in a central opening of the control valve holding element, coaxially adjacent to the axial opening, by means of a fixed connection.

11. The hydraulic valve play compensating element of claim 10, wherein the closing body is embodied as a spheroid or cone.

12. A hydraulic valve play compensating element claim 1, wherein the control valve closing element is embodied as a closing region which is integrated into the control valve holding element, coaxially adjacent to the axial opening.

13. A hydraulic valve play compensating element of claim 12, wherein the closing region which is integrated into the control valve holding element forms a spheroidal or conical surface.

14. A hydraulic valve play compensating element of claim 1, wherein a continuous transition region is formed between the control valve closing element, of the control valve holding element.

15. A hydraulic valve play compensating element of claim 1, wherein the valve seat and/or the axial opening is matched to the contour of the control valve closing element.

16. A hydraulic valve play compensating element of claim 1, wherein the control valve closing element is embodied as a closing body which floats freely between the control valve holding element and the valve seat, which closing body can be guided in the axial direction by means of the control valve holding element.

* * * * *